United States Patent [19]

Wezel et al.

[11] Patent Number: 4,624,061

[45] Date of Patent: Nov. 25, 1986

[54] RUNNING SHOES

[75] Inventors: Frank V. Wezel; Terry Mackness, both of Shoeburyness, England

[73] Assignee: Hi-Tec Sports Limited, Shoeburyness, England

[21] Appl. No.: 719,844

[22] Filed: Apr. 4, 1985

[30] Foreign Application Priority Data

| | | | |
|---|---|---|---|
| Apr. 4, 1984 | [GB] | United Kingdom | 8408700 |
| Apr. 11, 1984 | [GB] | United Kingdom | 8409358 |
| Aug. 15, 1984 | [GB] | United Kingdom | 8420758 |

[51] Int. Cl.[4] ..... A43B 13/12

[52] U.S. Cl. ..... 36/30 A; 36/32 R; 36/31; 36/114

[58] Field of Search ..... 36/30 A, 31, 32 R, 32 A, 36/28, 114

[56] References Cited

U.S. PATENT DOCUMENTS

| | | | |
|---|---|---|---|
| 190,113 | 5/1877 | Arnold | 36/31 |
| 1,575,813 | 3/1926 | Burke | 36/31 |
| 2,640,283 | 6/1953 | McCord | 36/31 |
| 3,785,646 | 1/1974 | Ruskin | 36/32 R |
| 4,235,026 | 11/1980 | Plagenhoef | 36/32 R |
| 4,316,332 | 2/1982 | Giese et al. | 36/28 |
| 4,364,188 | 12/1982 | Turner et al. | 36/31 |
| 4,364,189 | 12/1982 | Bates | 36/31 |
| 4,377,041 | 3/1983 | Alchermes | 36/31 |
| 4,378,642 | 4/1983 | Light et al. | 36/28 |
| 4,430,810 | 2/1984 | Beute | 36/32 R |
| 4,506,462 | 3/1985 | Cavanagh | 36/31 |
| 4,507,879 | 4/1985 | Dassler | 36/28 |

FOREIGN PATENT DOCUMENTS

| | | | |
|---|---|---|---|
| 2904540 | 8/1980 | Fed. Rep. of Germany . | |
| 210884 | 10/1984 | Fed. Rep. of Germany . | |
| 2396524 | 7/1977 | France . | |
| 2522482 | 9/1983 | France | 36/31 |
| 2092431 | 8/1982 | United Kingdom | 36/31 |
| 2520986 | 9/1983 | United Kingdom | 36/114 |

*Primary Examiner*—Werner H. Schroeder
*Assistant Examiner*—Mary A. Ellis
*Attorney, Agent, or Firm*—Pollock, Vande Sande & Priddy

[57] ABSTRACT

An improved construction of sole unit for running shoes features a longitudinally asymmetrical recess across the width of the heel area of the midsole and interchangeable inserts, differentiated by their durometer hardness, inserted to fill the recess, such that the shock absorption characteristics of the midsole can be suited to the user and the running surface and any tendency to over-pronation can be corrected, a larger anti-pronation insert being provided for insertion on the inner side of the heel and a smaller anti-supination insert being provided for insertion on the outer side of the heel and the two inserts being arranged to interlock with each other.

16 Claims, 6 Drawing Figures

RUNNING SHOES

FIELD OF THE INVENTION

This invention concerns improvements in or relating to running shoes and has as its object the provision of an improved running shoe which not only provides shock absorption but additionally provides control of the movement of the rear of the foot. Good shock absorption properties are desirable for prevention of such injuries as shin splints, as is well known, but it is also desirable to control the amount of rear-foot movement which can lead to knee and other injuries.

BACKGROUND OF THE INVENTION

In order to improve the shock absorption properties of running shoes it has become conventional to incorporate relatively thick and soft foam materials into the heel of the shoe so as to improve the cushioning effect of the shoe. However, such softer cushioning of the heel has provided less firm support to the heel and so has contributed directly to the problems of excessive rear-foot movement or instability. Good shock aborption and rear-foot movement control thus give rise to conflicting requirements.

For control of rear-foot movement it is required to restrain movement inside the shoe during running so as to limit the degree of pronation and/or supination of the foot. Pronation is the inward rotation of the foot about a horizontal axis parallel to the direction of motion, and supination is the outward rotation of the foot about the same axis. The human anatomy is such that when most people run, or walk for that matter, the foot initially contacts the ground during each step on the outside (valgus) edge of the sole somewhere between the heel and ball of the foot and the foot is supinated. As the weight on the foot increases so the ankle rolls or rotates inwards into a flat, stable position, passing through "neutral" to a slightly pronated position where the body weight of the runner is brought from the outside edge of the foot inwardly towards the center of the arch. The foot then rolls outwardly and toes off towards the great toe to complete the step. Pronation is thus a normal and essential function of the foot and it is only when it becomes excessive that problems can arise. Over-pronation occurs when the inward rotation of the foot continues to an excessive degree such that the weight is transferred to the inside (varus) edge of the sole.

It has been recognised that the vast majority of runners exhibit substantially different degrees of pronation when running in prior art shoes. Many people initially land on the outside edge of the heel of the ground contacting foot, with the foot rolling inwards with improper biomechanical action and remaining rolled inwards. Such improper action comprises overpronation. It has been established that, when running, three to four times the gravitational force is applied to the outside edge of the foot, and in particular to the heel area, than occurs during walking; this high force concentrated at the heel area, coupled with a tendency of most runners to roll their feet inwards forcefully during running, results in increased stressing of the foot and leg and increased heel wear of the shoe being worn, and as the shoe wears and its rear-foot support capabilities break down the problems are increased.

Shoes have been proposed, for example in FR-A-2 396 524, in which the sole of the shoe in the region of the heel is of non-uniform thickness between the inner (varus) side of the shoe and the outer (valgus) side of the shoe and, to similar effect, it has been proposed, for example in FR-A-2 522 482, to incorporate a transverse wedge of harder foam plastic material within the softer foam plastic material of the heel to reduce the amount of heel deformation at the inside edge. Yet a further proposal is disclosed in U.S. Pat. No. 4,235,026 and comprises the provision in an elastomeric shoe sole designed specifically for athletic activities of a plurality of transversely extending, longitudinally spaced openings at the outer side of the heel and extending to approximately the longitudinal center line of the shoe, and with the opposite side of the heel substantially solid, thereby allowing the sole to yield at the outer side of the heel to a greater extent than at the inner side. None of these prior art proposals has given any consideration to the different requirements of the individual users as regards their weight and running style, or to the fact that the shoes may be used under differing running conditions as for example different ground surfaces, and scant attention has been directed in the prior art to the restraint of rear-foot movement.

Consideration has been given in the prior art to the question of adapting the shock-absorbing capabilities of running shoes to the individual requirements of the user, and in No. DE-A-2 904 540 and U.S. Pat. No. 4,430,810 there is described an arrangement wherein a number of bores extend through the relatively soft material of the heel portion of a running shoe from one side thereof to the other, with the bores being spaced apart from each other in the longitudinal heel-to-toe direction of the shoe, and rod-shaped stiffening members of selectable greater hardness than the soft heel material can be inserted into the bores so as selectively to increase the overall hardness of the sole and adapt the shock-absorbing capabilities of the shoe to the individual requirements of the runner and to the nature of the surface upon which he intends to run. As described in DE-A-2 904 540, the heel itself can be made of a plastic foam material having a comparatively low Shore hardness of only about 35, and the supporting members can be made of all possible materials such as PVC, polyethylene, polyamide, nylon and even of metal. The proposal to stiffen the heel of a shoe by insertion of appropriate stiffening elements into bores in the heel is known also from FR-A-958 766, and in U.S. Pat. No. 3,785,646 there is disclosed a shoe having a rubber sole with transverse bores into which rod-like metal weights may be inserted. In none of these documents is any consideration whatsoever given to the question of control of rear-foot movement.

There is further described in DE-GM-8335315 (which was filed on Dec. 9, 1983, namely before the earliest priority date of the present application, but was not registered until Sept. 20, 1984 and was not made available until Oct. 31, 1984, namely after the latest of the priority dates of the present application) a sole arrangement for sports shoes which is a variation of the arrangement described in DE-A-2 904 540 designed to enable variable heel cushioning to be achieved even at the rear edge of the heel where the transverse stiffening arrangement of DE-A-2 904 540 cannot be used. In accordance with the proposal of DE-GM-8335315, a longitudinal recess is provided in the relatively soft heel material and extends from the rear edge of the heel for receiving a longitudinal support element of selectable hardness, and a transverse recess extending between the inner and outer edges of the heel intersects the longitudinal recess for receiving a pair of transverse support elements, each of selectable hardness which interlock with the longitudinal support element on opposite sides thereof. Even in this arrangement, where it is said that each of the three support elements can have different qualities or features, the problems of rear-foot instability are not considered, and it is even suggested to incorporate a stiffener in the outer transverse support member which would exacerbate any problems of over-pronation.

OBJECT OF THE INVENTION

It is thus a general object of the present invention to provide running shoes which overcome or at least substantially reduce the disadvantages inherent in the prior art running shoes and, more particularly, to provide a pair of neutral plane shoes, i.e. shoes wherein the sole is of generally uniform thickness between the inner and outer sides of the shoe as opposed to the inclined plane shoes of FR-A-2 396 524, for example, each of which has means for controlling rear-foot movement and thus for lessening abnormal pronation of the foot as the arch flattens during running. It is a specific object of the invention that the aforementioned means for lessening pronation should be capable of being changed to suit the particular running style of the person wearing the running shoes and/or the nature of the surface upon which he wishes to run.

SUMMARY OF THE INVENTION

These objects are attained by the present invention according to which each of a pair of running shoes comprising an upper and a sole running the length of the shoe from heel to toe, the sole comprising an outsole and a midsole, has its midsole constructed with a longitudinally asymmetrical recess extending across the width of the heel area of the shoe and having a greater longitudinal dimension on the inner (varus) side of the heel than on the outer (valgus) side, and non-symmetrical inserts are provided to be fitted into the aforementioned recess from both sides of the shoe, namely, a relatively large insert for the inner side of the recess and a relatively small insert for the outer side, said inserts being of such dimensions as to fill the recess sufficiently so as when formed of appropriate materials to provide adequate support and cushioning under running conditions. Additionally, the large and small inserts are designed to interlock with each other and/or with the recess within the midsole, such that they cannot be expelled from the midsole during running by the considerable forces generated during each step. The inserts are of different durometer hardnesses from the material comprising the midsole, and may be of different durometer hardnesses from each other.

In accordance with an exemplary embodiment of the invention which will hereinafter be described in detail, the larger insert for insertion at the inner side of the heel, i.e. the insert which provides the anti-pronation function, is of a generally rectangular configuration with a major dimension of the order of twice its minor dimension, and is arranged so that when inserted its major dimension extends generally longitudinally of the shoe and its minor dimension extends transversely to about the medial line of the heel portion of the shoe. Generally circular lobes are formed at the notional inner corners of the generally rectangular shape of the larger insert, and a cut-out is formed in the inner edge of the insert, between the lobes, for engagement with a head portion of the smaller insert. The smaller insert likewise is generally rectangular with a major dimension and a minor dimension, but fits into the recess in the shoe sole with its minor dimension extending longitudinally of the shoe and its major dimension extending transversely. A complementarily shaped head portion at the inner end of the smaller insert is adapted to engage in the cut-out formed in the inner edge of the large insert. Both inserts have a generally flat configuration and are of a thickness generally equal to the thickness of the midsole of the shoe. The recess is of a shape complementary to that of the engaged inserts. The inserts are further arranged so as when received within their accommodating recess within the shoe sole, to have a portion which projects outwardly of the shoe sole and enables the inserts to be grasped for ready interchangeability.

Other alternative forms of inserts are also described hereinafter, and the present invention is not to be regarded as restricted to any particular form of insert. It is proposed furthermore to make the inserts available in a plurality of different durometer hardnesses, which might if desired be color coded, so that the user can in effect customize the shoe to his own running style and/or to the nature of the surface upon which he is intending to run. The inserts are preferably formed from EVA (ethylene vinyl acetate) and might for example be provided in 50 degree (yellow), 60 degree (blue) and 70 degree (red) durometer hardnesses.

The construction of the sole according to the invention enables it to be configured so as to lessen abnormal pronation and, to a lesser extent, to lessen supination. In addition, the inserts may be selected by the user so that impact shock is evenly distributed during running according to the running style of the wearer or according to the nature of the running surface. At the same time, the shoes preferably employ a transversely level or "neutral plane" sole which provides a more natural feel to a user than previously proposed inclined plane shoes.

BRIEF DESCRIPTION OF THE DRAWINGS

The invention, together with features objects and advantages thereof, will become more apparent from consideration of the following detailed description of exemplary embodiments which are illustrated in the accompanying drawings wherein.

DETAILED DESCRIPTION

Figure 1:
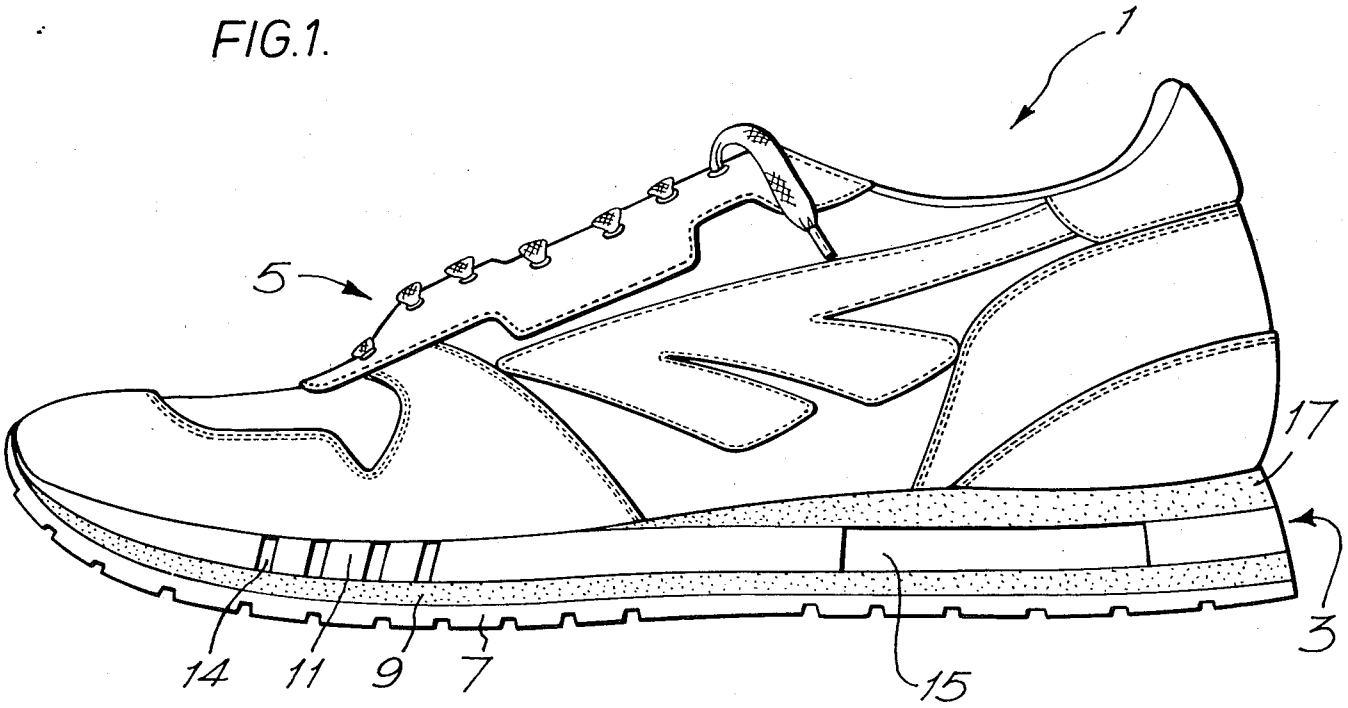
FIG. 1 is a view of an exemplary running shoe including an embodiment of the sole of the invention.

Referring to FIG. 1, a running shoe, generally designated 1, is shown. The shoe 1 includes a sole 3 and an upper 5 secured to the sole, the upper (as is conventional) including a reinforced counter or heel cup surrounding the heel portion of the shoe.

The sole has a synthetic rubber base 7, in which a tread pattern of gripping elements or cleats is formed. The base 7 is attached, for example by means of adhesive or by welding, to a first resilient midsole layer 9, which is in turn attached to a further resilient midsole layer 11, for example by means of adhesive or by welding. The midsole layers 9, 11 may be formed from foamed plastic materials and could if desired be formed in one piece rather than as two separate pieces. The layer 11 has a number of widthwise flex channels 14 positioned to register with the ball of the foot for facilitating forefoot movement and providing an air cushioning effect, and is further formed with a transverse asymmetrical recess 13 (shown most clearly in FIGS. 2 to 4) in the heel portion of the shoe, for receiving a pair of inserts as will hereinafter be described.

A further resilient heel wedge layer 17 formed from foamed plastic material is provided at the heel end of the shoe 1. The layer 17 raises the heel portion of the shoe, and also covers over the recess 13. The layer 17 may be attached to the layer 11 by means of adhesive or by welding, for example, and may be formed all in one piece or alternatively may be formed in two or more longitudinally extending pieces which advantageously can have increasing durometer hardnesses towards the inside of the heel.

The complete sole 3 may be secured to the upper 5 by means of adhesive, for example, and an insole preferably will be provided within the shoe.

Figure 2:
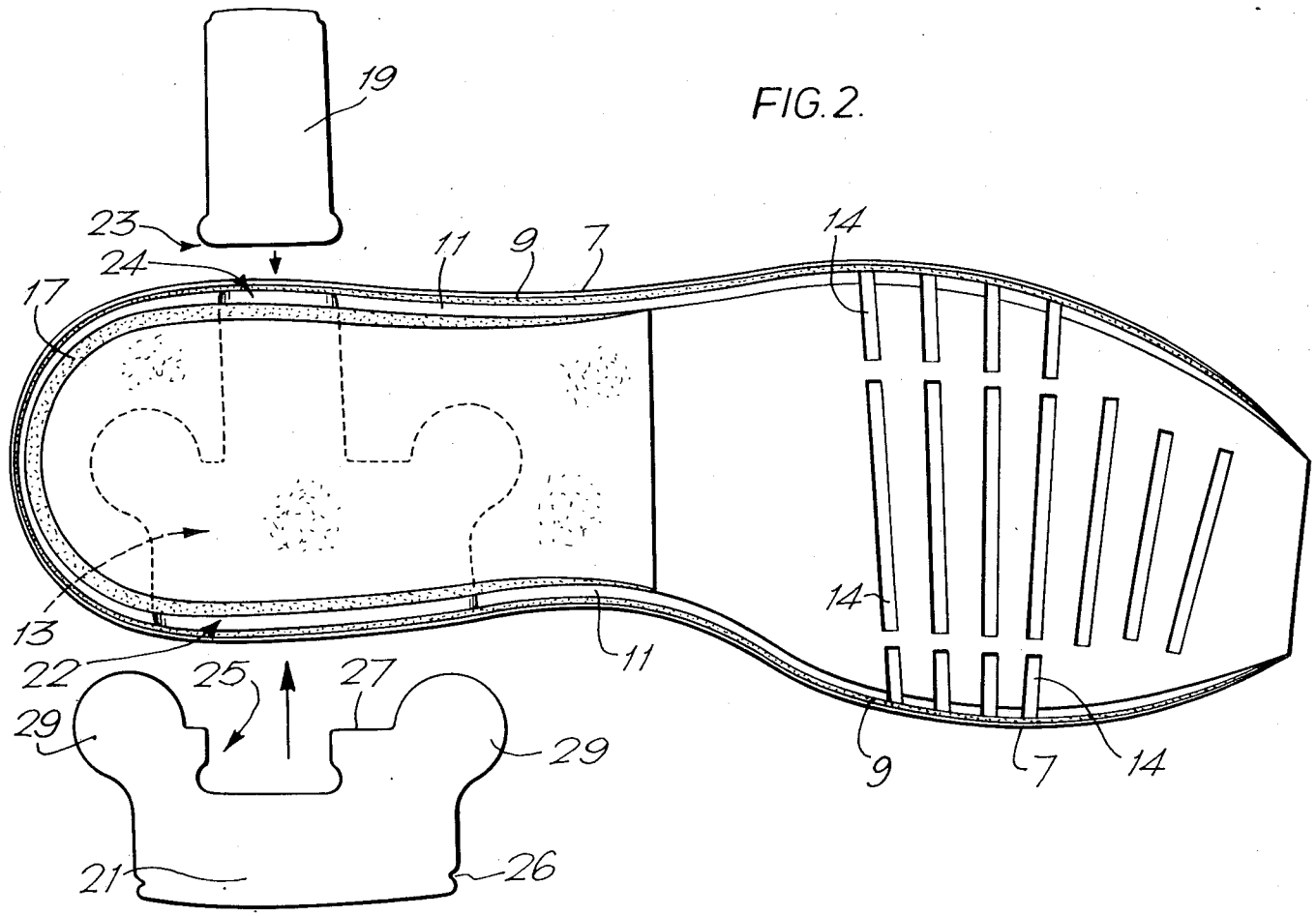
FIG. 2 is a plan view of the sole of the shoe of FIG. 1 with the inserts removed from their accommodating sole recess.
Figure 3:
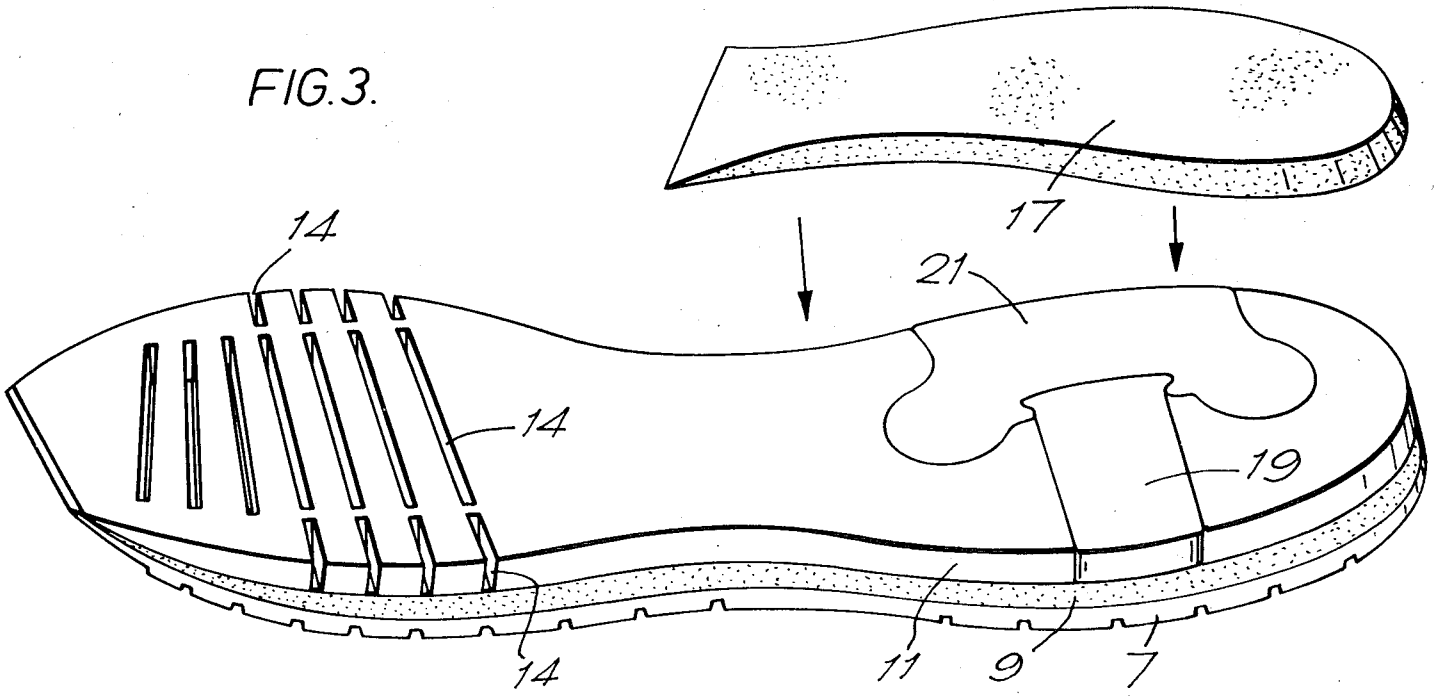
FIGS. 3 and 4 are perspective views from opposite sides of the sole shown in FIG. 2 and with the heel wedge shown disassembled.
Figure 4:
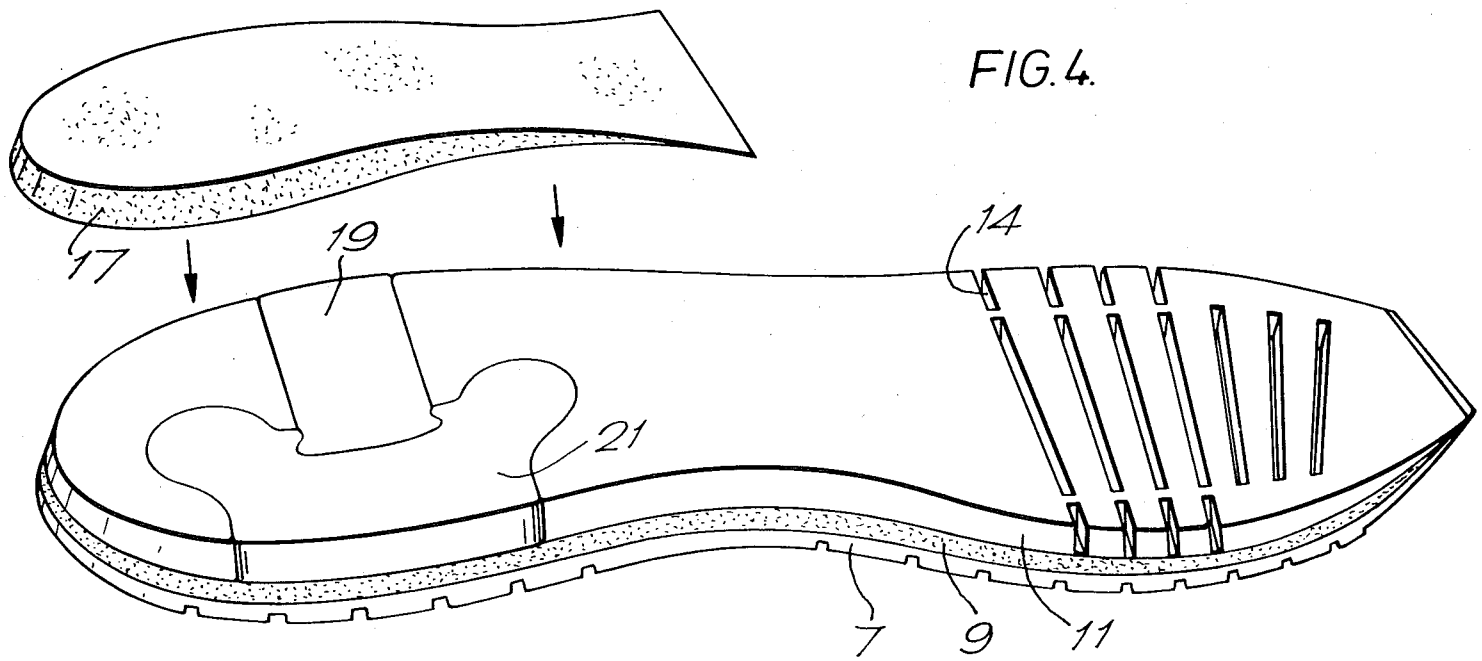

As shown most clearly in FIGS. 2 to 4, the inserts comprise two cooperating pieces 19, 21 formed from resilient plastic material of constant thickness corresponding to the thickness of midsole layer 11. The pieces 19, 21 are designed to interlock with each other and, when interlocked, conform to the complementary shape of the recess 13 formed in the layer 11, and are dimensioned so as when inserted to project slightly outwardly beyond the edge of the shoe sole so that, with the aid of indents 26 shown in FIG. 2, the inserts can be grasped for ease of removal from the recess 13.

As shown most clearly in FIG. 2, the two insert pieces are each of generally rectangular form, the smaller of the two pieces more regularly so than the larger one. The larger insert goes to the inside edge of the heel portion of the shoe sole and has its major dimension extending lengthwise of the sole over a very substantial part of the heel portion of the shoe, and its minor dimension extending generally to the longitudinal center line of the heel portion. The smaller insert goes to the outer edge of the heel portion of the shoe sole and, in contrast to the larger insert, has its major dimension extending transversely to the length of the shoe and its minor dimension, which is substantially less than the corresponding dimension in the same direction of the larger insert, extending lengthwise of the shoe. As shown, the smaller insert 19 has an enlarged head portion 23 adapted to engage with a complementarily shaped cut-out 25 formed in the inner edge 27 of the large insert 21. Bulbous lobes 29 are formed on the larger insert at the notional inner corners thereof as shown and serve not only to engage the larger insert 21 with the recess 13 in a locking manner, but also to a degree to effect the shock absorbency characteristics of the shoe.

When inserting the inserts 19, 21 within their receiving recess 13, insert 21 is inserted first, through the larger edge slot 22 defined by recess 13 in the inner edge of the heel. Insert 19 is then pressed through the opposed edge slot 24 defined on the outer edge of the heel and into resilient engagement with insert 21 with the enlarged head portion 23 of insert 19 engaged with the complementarily shaped cut-out portions 25 of insert 21, thus locking the inserts in place within the sole 3. The inserts may be lubricated with an appropriate lubricant to aid their insertion into and removal from their accommodating recess.

Figure 5:
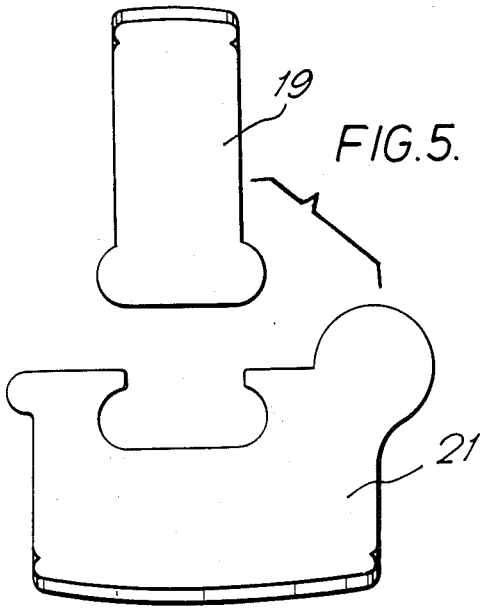
FIGS. 5 and 6 show alternative forms of inserts which can be used in the practice of the invention.
Figure 6:
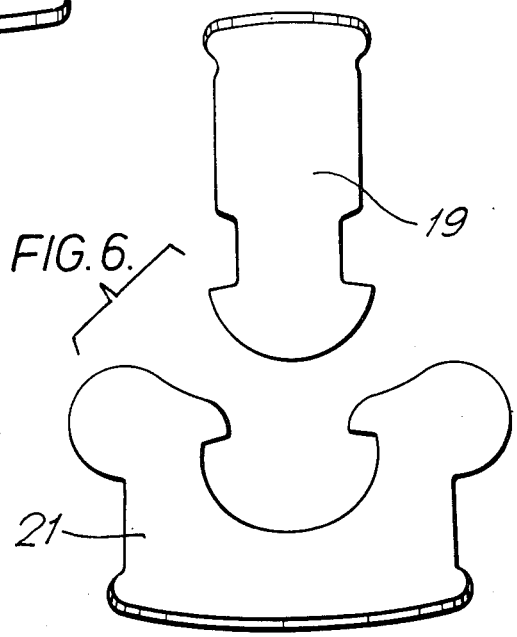

FIGS. 5 and 6 show alternative insert configurations which are but examples of the many insert configurations which could be employed in the practice of the present invention. The insert configuration of FIG. 5 is only slightly modified as compared to the insert configuration hereinbefore described, in that one of the bulbous lobes 29 provided on the larger insert is replaced with a lip, and the accommodating recess in the shoe will be correspondingly modified. The insert configuration of FIG. 6 is designed for use with the same recess configuration as hereinbefore described and is designed to enable the inserts to be more readily inserted and removed than the previously described inserts, but without reducing the effectiveness of their interlocking with each other and with the recess in the shoe.

The insert configurations hereinbefore described achieve the design requirements that the inserts may simultaneously be inserted into the recess from opposing sides, that they may give adequate and properly located support during use, and that they interlock sufficiently to prevent one or the other insert from being expelled from the sole during use. It should be pointed out at this juncture that the material from which the midsole and plugs are constructed, typically ethyl vinyl acetate (EVA), is sufficiently flexible that the extremities of the larger insert 21 may be squeezed together sufficiently to enter the large side of the recess, and similarly the enlarged head of the smaller insert may be forced into the small side of the recess and fully inserted to engage the cut-out formed in the larger insert, all within the confines of the internal dimensions of the recess.

The midsole is formed as a composite structure, and the durometer hardness of any element in the midsole may be varied according to the design of the shoe. The durometer hardness of the inserts may be varied by the user, according to running technique or conditions pertaining to the run, and to this end a supply of inserts of correct configuration and differing durometer hardnesses is necessary to make the invention fully effective.

As previously explained, the motion of rolling from the outer (valgus) side of the foot to the inner (varus) side is known as pronation. A runner who pronates, that is a pronator, will use a high density plug on the varus side to minimize the tendency towards overpronation, since a higher durometer hardness will resist the excessive compression which allows over-pronation to occur. Similarly, the few runners who roll from the varus side to the valgus side, supinators, will use a higher durometer plug on the valgus side.

Furthermore, runners can be differentiated between rear-foot strikers, whose rear foot makes initial contact with ground, and mid-foot strikers, who land medialongitudinally. Mid-foot strikers are less likely to pronate, and could therefore use plugs of similar durometer hardness to that of the midsole. Rear foot strikers tend to pronate or supinate and would therefore use plugs of higher durometer hardness in the manner previously described.

It will be understood that the two shoes of a pair are of corresponding construction in mirror image with respect to each other and that the shoes can, of course, be set up entirely differently from each other.

Purely by way of illustration, the midsole region of a shoe constructed in accordance with the invention might be constructed with a durometer hardness of the order of 45° or 50°, and different colour-coded inserts might be provided with durometer hardnesses of 50° (yellow), 60° (blue) and 70° (red).

Having thus described the invention with reference to exemplary embodiments thereof, it will be appreciated by those possessed of appropriate skills that various alterations and modifications could be made to the described embodiments without departure from the scope fo the invention as set forth in the appended claims. Thus, for example, whereas in the foregoing the inserts have comprised two interlocking parts, they could be arranged to comprise more than two parts if desired, with the essential feature being that a longitudinally asymmetrical insert configuration is obtained which is larger on one side of the shoe than on the other.

We claim:

1. A running shoe having a sole structure which includes a heel portion formed of a shock-absorbing material and having a recess extending with an elongate slot-like cross-section fully across the width of said heel portion between a first, longer, elongate, slot-like opening on the inner side of the heel and a second, shorter, elongate, slot-like opening on the outer side of the heel, the directions of elongation of said openings and of the slot-like cross-section of the recess being generally parallel to the plane of the shoe sole and the recess being shaped in the plane generally including the directions of elongation of said first and second openings so as to be asymmetrical with respect to the general longitudinal heel-to-toe axis of the shoe, with a major portion of the recess being located at the inner side of the heel and a minor portion of the recess being located at the outer side of the heel, and said recess removably and interchangeably receiving therein an insert which at least substantially completely fills the recess, said insert being of selectable hardness characteristics for adapting the shoe to the individual requirements of the user and particularly for selectively providing anti-pronation and anti-supination properties.

2. A shoe as claimed in claim 1, wherein said insert is comprised of two parts adapted to be fitted into said recess from opposite sides thereof, said two parts comprising a larger part to be inserted into the recess from the inner side of the heel portion and a smaller part to be inserted into the recess from the outer side of the heel portion, and each of said two parts having individually selectable hardness characteristics.

3. A shoe as claimed in claim 2, wherein the two parts of the insert are adapted to interlock with each other when inserted into the recess.

4. A shoe as claimed in claim 3, wherein the insert and the recess are shaped complementarily so that the insert interlocks with the recess when inserted therein.

5. A shoe as claimed in claim 2, wherein the insert comprises a major portion and a minor portion, and the major portion has a major dimension extending longitudinally of the shoe and a minor dimension extending transversely of the shoe generally to about the centerline of the heel of the shoe, and the minor portion has a much lesser extent in the longitudinal direction of the shoe than has the major portion and similarly to the major portion extends transversely of the shoe generally to about the centerline of the heel of the shoe.

6. A shoe as claimed in claim 5, wherein the major insert portion is generally rectangular and has at its inner edge a formation adapted for engagement with a complementary formation provided at the inner end of the minor portion.

7. A shoe as claimed in claim 5, wherein the minor portion of the insert has a major dimension extending transversely of the shoe and a minor dimension extending longitudinally of the shoe.

8. A shoe as claimed in claim 7, wherein the minor portion of the insert is generally rectangular.

9. A shoe as claimed in claim 3, wherein one of said major and minor portions comprises formations adapted for engagement with complementarily shaped formations provided in said recess.

10. A shoe as claimed in claim 1, wherein said insert comprises a generally planar element having a generally rectangular cross-section and of a thickness less than the thickness of the heel portion of the sole of the shoe, and the recess is of a generally complementary planar shape extending generally parallel to the sole of the shoe.

11. A shoe as claimed in claim 1, which comprises an outsole layer formed of relatively hard material, a midsole layer formed of relatively soft shock-absorbent material, a heel wedge formed of relatively soft shock-absorbent material, and an upper, and wherein said recess is formed as a discontinuity in said midsole layer.

12. A shoe as claimed in claim 11, wherein the material of said midsole has a relatively low durometer hardness, and the material of the insert has a durometer hardness selectable from relatively low, medium and hard values compared to the hardness of said midsole.

13. A shoe as claimed in claim 12, wherein said midsole and said insert are formed from ethylene vinyl acetate (EVA).

14. A running shoe comprising an upper and a sole running the length of the shoe from the heel to the toe, the sole comprising an outsole and a midsole, and the midsole being constructed with a recess extending with an elongate slot-like cross-section generally parallel to the sole plane of the shoe fully across the width of the heel area, said recess being shaped asymmetrically with respect to the general longitudinal center line of the heel so as to have a major portion on the inner side of the heel terminating at a first opening in the inner side edge of the sole and a minor portion on the outer side of the heel terminating at a second opening in the outer side edge of the sole, said inner side opening being longer in the longitudinal heel-to-toe direction of the sole than the outer side opening, and first and second inserts removably inserted into said recess through said side openings in the sole, said inserts being of such dimensions as to fill the aforementioned recess sufficiently to provide adequate support and cushioning under running conditions and being of such design as to interlock within the midsole so as to prevent their expulsion from the midsole during running, and said inserts furthermore being of selectable and interchangeable hardness characteristics.

15. A running shoe comprising an outsole formed of relatively hard material and incorporating a tread pattern, a midsole formed of at least one layer of relatively soft shock-absorbent material, a heel wedge, and an upper, said midsole having formed therein in a region thereof which corresponds to the heel of the shoe a generally flat recess of longitudinally asymmetrical shape extending between and opening to opposite sides of the heel of the shoe with a larger part of the recess opening to the inside edge of the shoe and a lesser part opening to the outside edge of the shoe, and a first insert removably received in said larger recess part via the inside edge opening and a second insert removably received in the lesser recess part via the outside edge opening, said first and second inserts interlocking with each other within said recess and together being complementary in shape to said recess whereby the inserts are positively retained within the recess during running, and said inserts being selected from a range of inserts of different durometer hardnesses so as to customize the running shoe to the individual requirements of the user and in particular so as selectively to counter any tendency of the user towards over-pronation and over-supination.

16. A running shoe as claimed in claim 15 wherein said range of inserts of different durometer hardnesses are color coded as to their respective hardnesses.

* * * * *